US006476693B1

(12) United States Patent
Snyder et al.

(10) Patent No.: US 6,476,693 B1
(45) Date of Patent: Nov. 5, 2002

(54) METAL DIELECTRIC COMPOSITE RESONATOR

(75) Inventors: Richard V. Snyder, Kinnelon, NJ (US); Charlotte Alvarez, Morganville, NJ (US)

(73) Assignee: New Jersey Institute of Technology, Newark, NJ (US)

( * ) Notice: Subject to any disclaimer, the term of this patent is extended or adjusted under 35 U.S.C. 154(b) by 0 days.

(21) Appl. No.: 09/701,053

(22) PCT Filed: Sep. 15, 1998

(86) PCT No.: PCT/US98/19106

§ 371 (c)(1),
(2), (4) Date: Nov. 22, 2000

(87) PCT Pub. No.: WO00/16432

PCT Pub. Date: Mar. 23, 2000

(51) Int. Cl.[7] ..... H01P 7/10
(52) U.S. Cl. ..... 333/219.1; 333/202; 333/212
(58) Field of Search ..... 333/219.1, 202, 333/208, 212

(56) References Cited

U.S. PATENT DOCUMENTS 2,890,422 A * 6/1959 Schlicke ..... 333/219.1
4,179,673 A * 12/1979 Nishikawa et al. ..... 333/204
4,757,289 A 7/1988 Kosugi et al. ..... 333/209
5,140,285 A 8/1992 Cohen ..... 331/96
5,220,300 A 6/1993 Synder ..... 333/210
5,356,844 A 10/1994 Hirahara et al. ..... 501/136
5,781,085 A * 7/1998 Harrison ..... 333/202

* cited by examiner

*Primary Examiner*—Robert Pascal
*Assistant Examiner*—Stephen E. Jones
(74) *Attorney, Agent, or Firm*—Richard C. Woodbridge, Esq.; Thomas J. Onka, Esq.

(57) ABSTRACT

A composite resonator (10) consisting of a conducting metal (14) and a dielectric material (12) is used to provide resonant frequencies lower than can be obtained using the same volume of dielectric alone and with higher unloaded Q than can be obtained using the same volume of metal imbedded into a cavity and used as a resonator. This significantly reduces the cost and size of the resonator (10) without degrading its performance. An inexpensive metal (14), such as aluminum, can be substituted for more than half of the dielectric (12) and stille form a resonator (10) with substantially equivalent resonant properties. The operative embodiments of the resonator invention (1) cover composites with doughnut-shaped, i.e., cylindrical, configurations, with the "doughnut" either metal (14) or dielectric (12), and the "hole" either dielectric (314) or metal (312), respectively.

3 Claims, 8 Drawing Sheets

METAL DIELECTRIC COMPOSITE RESONATOR

BACKGROUND OF THE INVENTION

1. Field of the Invention

The invention relates to a resonator composed of a conducting metal ring surrounding a cylindrical dielectric core material which can be incorporated into multi-cavity filters for frequency separation.

2. Description of Related Art

Dielectric resonator filters are a class of stable microwave filters that are frequently used in radar and communications systems. Dielectric resonators are often utilized in filter circuits because of an intrinsically high Q value. These characteristics allow a filter employing a dielectric resonator to have excellent frequency stability with only a small amount of frequency drift over a wide range of temperatures and environmental conditions. The Q value of a dielectric resonator is defined as the ratio between the energy stored per cycle to the energy dissipated per cycle.

Dielectric resonators are typically made of a ceramic type material having a high dielectric constant ($\in_r$=20 to 90) and a low dissipative loss. These characteristics allow the dielectric resonator to store energy with relatively little internal energy dissipation. This corresponds to a high Q value.

One significant limitation of the practical use of dielectric resonator filters is the cost of the dielectric itself. The cost of a typical prior art 6" ceramic dielectric cylindrical resonator can cost three hundred dollars or more. In addition, the size of the resonator substantially increases the size of any multi-cavity filter in which it might be employed.

The following patents are generally representative of typical prior art dielectric resonators: U.S. Pat. Nos. 4,757,289; 5,140,285; and, 5,356,844.

Resonators are typically employed in filters for the wireless communication industry. Such filters typically include a plurality of resonators located in adjacent cavities and coupled to each other through a variety of different means. One coupling mechanism known in the prior art is the use of a tunable iris as described in U.S. Pat. No. 5,220,300 entitled "RESONATOR FILTERS WITH WIDE STOPBANDS" and issued on Jun. 15, 1993 and assigned by Richard V. Snyder to RS Microwave Company, Inc., the entire contents and substance of which is incorporated herein by reference. Other cutoff means are also known, but few are known that would be suitable for composite resonators such as described in this disclosure.

What is clearly missing in the prior art, therefore, is a relatively inexpensive resonator, of reasonably small size, that can be used in a multi-cavity filter structure without appreciable loss in performance.

SUMMARY OF THE INVENTION

Briefly described, the invention comprises a composite resonator preferably including a cylindrical ceramic core and an exterior metal layer that surrounds most of the exterior circumference of the core and wherein the resonator resonates in substantially bound modes. This composite configuration is used to provide resonant frequencies lower than can be obtained using the same volume of dielectric alone and with higher unloaded Q than can be obtained using the same volume of metal imbedded into a cavity and used as a resonator. An inexpensive metal, such as aluminum, can be substituted for more than half of the dielectric and still form a resonator with substantially equivalent resonance properties.

According to alternative embodiments of the invention, the resonators are incorporated into spectrum filters for separation of frequencies. As contrasted to .conventional prior art implementations, the new technique achieves similar, or better, electrical performance; similar, or reduced, size; and significantly reduced cost for applications in the frequency range below 2.5 Ghz, thus including PC, wireless, AMPS and GSM applications, as well as a myriad of other applications in this frequency range. With spectrum currently selling for up to $45.00 per Hz, filters are very valuable for providing users the opportunity to utilize all spectrum available. Yet, the cost of the filters must ultimately be borne by the users, so reductions in cost are important to commercial applications. The present invention in its various embodiments contributes to such a reduction in cost.

These and other features of the invention will be more fully understood by reference to the following drawings.

DETAILED DESCRIPTION OF THE INVENTION

During the course of this description like numbers will be used to identify like elements according to the different figures that illustrate the invention.

Figure 1:
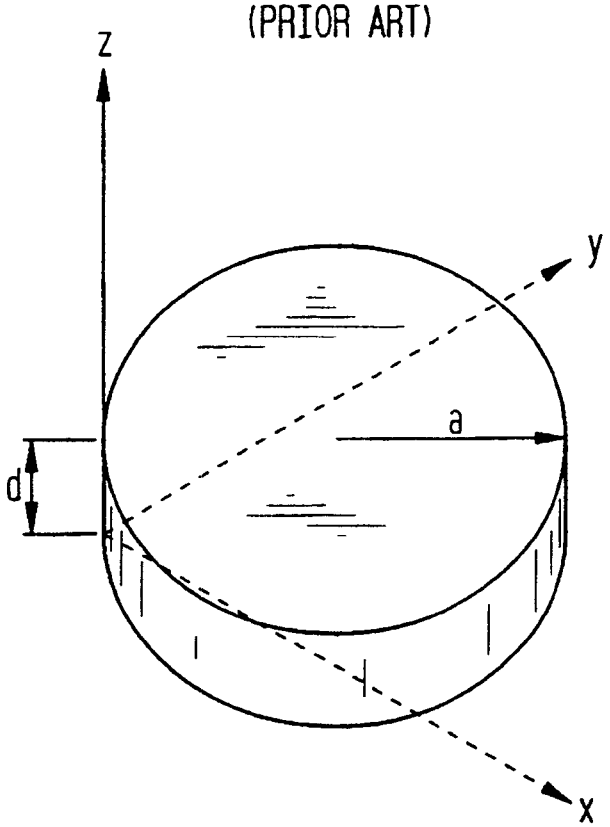
FIG. 1 (PRIOR ART)
FIG. 1 is a perspective view of a prior art ceramic resonator core.
Figure 2:
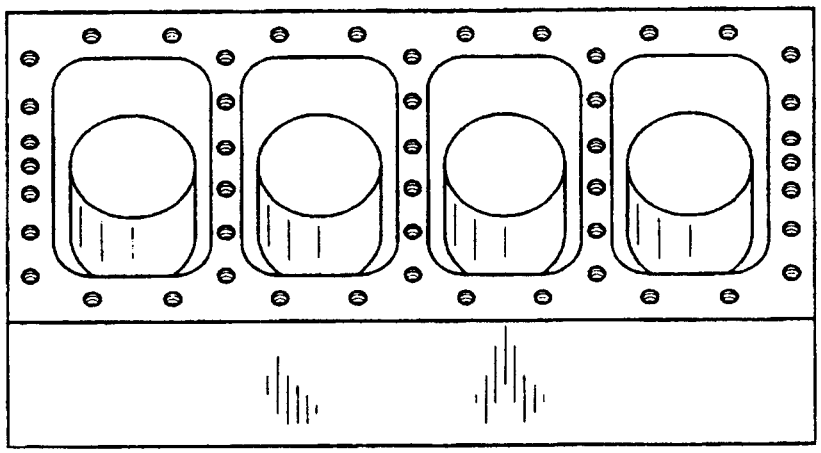
FIG. 2 (PRIOR ART)
FIG. 2 is a perspective view of a prior art multi-cavity filter including four prior art ceramic resonators.

FIG. 1 illustrates a typical prior art dielectric resonator. Such prior art resonators are typically relatively large and made of a single material, such as ceramic. Because of their size they can be relatively expensive to manufacture. In addition, their larger size in turn dictates that any filter in which they are used will also be relatively large, and thus display undesirable spurious responses in close proximity to the resonant frequency of the resonator. See FIG. 2 for a typical prior art multi-cavity four-stage filter including four prior art dielectric resonators.

Figure 3A:
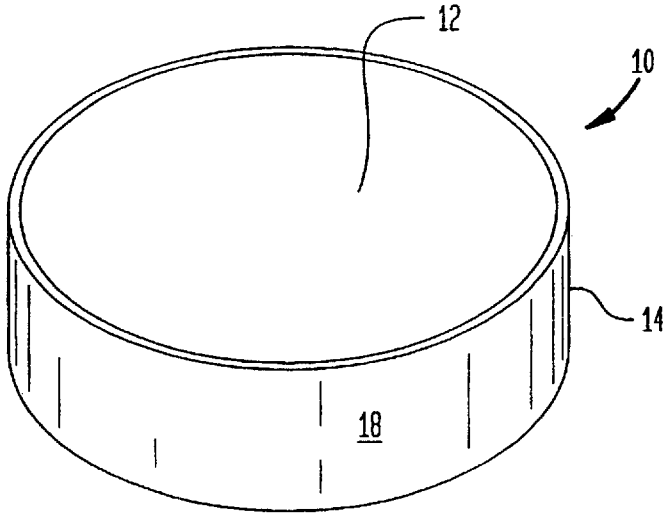
FIG. 3*a* is a perspective view of a composite resonator that comprises a dielectric core surrounded by an exterior metal layer according to the preferred embodiment of the invention.
Figure 3B:
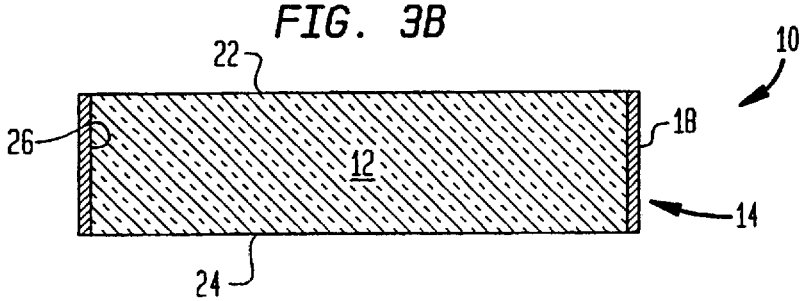
FIG. 3*b* is a vertical cross-sectional view of the preferred embodiment of the resonator shown in FIG. 3*a*.
Figure 3C:
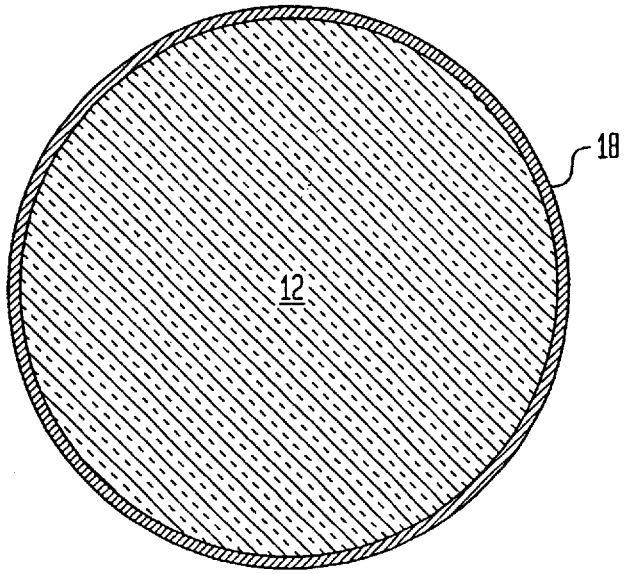
FIG. 3*c* is a top cross-sectional view of the resonator according to the preferred embodiment a illustrated in FIGS. 3*a* and 3*b*.

A composite resonator 10, according to the preferred embodiment of the invention, is illustrated in FIGS. 3*a*–3*c*. The preferred resonator 10 includes a ceramic core 12 surrounded by a metal layer 14 to form a "doughnut" or "hockey puck" shape. The core 12 includes a top surface or face 22, a bottom surface or face 24, and an interior sidewall surface or face 26. As best seen in FIG. 3*b*, the circumference 26 of the core 12 is surrounded by a sidewall metallic band or layer 18. The metallic layer 14 is, of course, the side layer 18. The metallic layer 14, i.e., ring 18, is preferably at least 2–3 skin depths thick or deep. Ring 18 can be much thicker but must be at least 2–3 skin depths to operate properly. The term skin depth is well known in the prior art and defined as ⅙.

Figure 4:
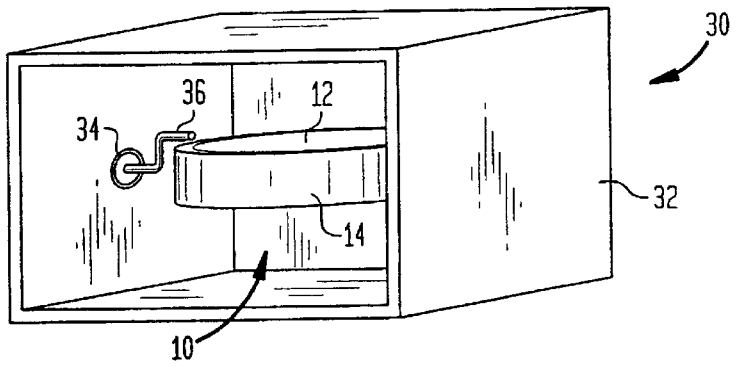
FIG. 4 is a perspective view of one embodiment of the invention showing the metal dielectric composite resonator according to the preferred embodiment utilized in a basic filter resonator having a ferrite or garnet disk, magnetically tunable in frequency.

FIG. 4 illustrates a relatively simple, basic embodiment 30 in which the resonator 10 is employed as a filter. The resonator 10, which includes the core 12 and the surrounding metal layer 14, as described with regard to FIGS. 3*a*–3*b*, is located in a structure, or housing, 32 and fed by a conventional probe 36 supported at anchor point 34. The $\in_r$, and $\mu$ can be chosen to vary the characteristics of the resonator. The resonator 10 comprises a ferrite or garnet disk, magnetically tunable in frequency.

According to the preferred embodiment of the present invention, composite resonators are used in a resonator apparatus that operates in a substantially bound mode. In a substantially bound mode, the signal is essentially contained within the high dielectric material and is essentially non-radiating. This is due to the almost perfect reflecting boundary conditions resulting from both the selective use of conductive metallization on the periphery and the critical angle of reflection at the non-metallized boundaries of high dielectric constant material ($\in_r \geqq 10$, and typically $\in_r = 24$ or greater) with the low dielectric ($\in_r = 1$) air filling the enclosures. What is important is the ratio of dielectric constant filling the resonator to that filling the cavity, external to the resonator. To ensure almost perfect reflection and thus resonance of substantially bound modes, the ratio should be at least 15:1. Examples of substantially bound modes function in this application are the $TE_{oin}$ modes which exist substantially without leakage in the structure described herein. In the example mode, the subscripts refer to the number of circumferential, radial and longitudinal magnetic field variations (for the case of a cylinder).

The invention 10 is not limited to round doughnut shapes, as the principle also applies to planar configurations or parallelepiped resonator configurations. The invention also applies to planar configurations in which metal dielectric composites are used to form artificial dielectric screens for application to antennas and similar devices.

Substantially bound modes become unbound only at specific interfaces wherein coupling mechanisms such as irises, tuning screws, or other perturbations are present, and then only for purposes of enhancing coupling of a portion of the substantially bound mode to another structure such as another resonator or port. FIGS. 5–10 depict such coupling mechanisms in various combinations.

The foregoing invention is described primarily in the context of a cylindrical example. It should be understood, however, that it can operate in any of the recognized nine "separable geometries". "Separable geometries" is a term known in the prior art and is described, for example, in "Methods of Theoretical Physics", by Morse and Feshbach, McGraw Hill, 1953. The geometries, which are included in the nine separable modes, are believed to be the only ones which can support more than one orthogonal mode simultaneously.

Figure 5:
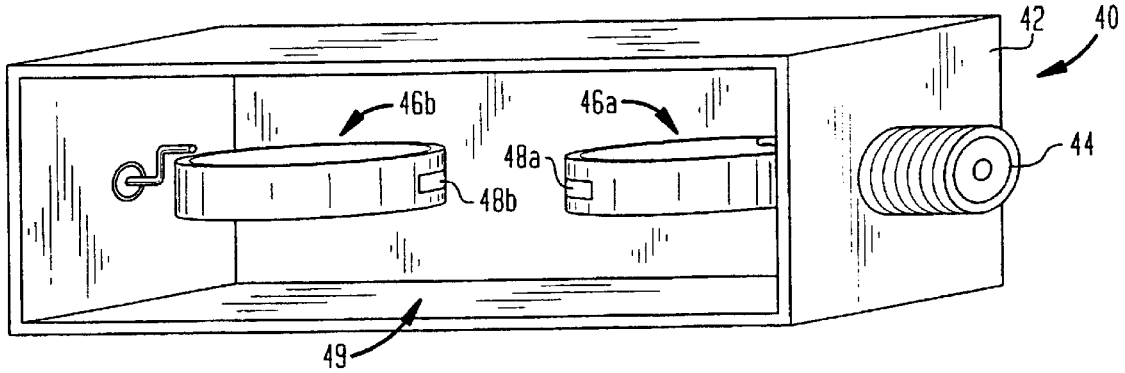
FIG. 5 is a perspective view of an alternate embodiment illustrating two metal dielectric composite resonators according to the present invention, each with a window facing one another in their metallized circumference, thereby permitting coupling of energy between the two resonators.

FIG. 5 illustrates a filter embodiment 40 housed in a structure 42 having a cavity 49 and a standard energy feed port 44. A first and a second composite resonator 46*a* and 46*b* are attached at opposite ends of the cavity 49. The first resonator 46*a* includes a small window 48*a* located in the metallic sidewall sufficient to expose the underlying dielectric core 12. Similarly, the second composite resonator 46*b* includes a window 48*b* in its metallic sidewall that faces window 48*a* of the first resonator 46*a*. Energy from the first resonator 46*a* is coupled through window 48*a* to window 48*b* of the second composite resonator 46*b*.

Figure 6:
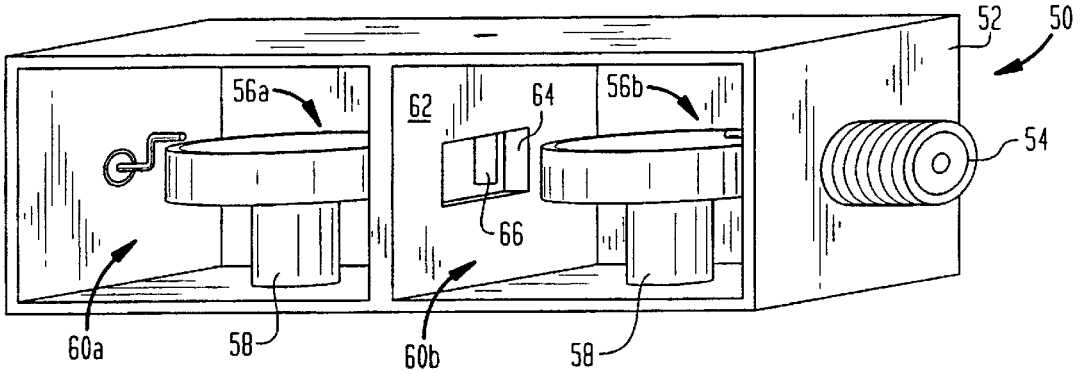
FIG. 6 is a perspective view of another alternate embodiment of the invention illustrating a coupled filter in which two metal dielectric composite resonators according to the present in vention are coupled by means of a tunable iris.

Another coupling embodiment 50 is illustrated in FIG. 6. Filter, or coupling, embodiment 50 comprises a housing structure 52 that includes a pair of cavities 60*a* and 60*b*. Energy is coupled into the cavity by a standard fitting 54. Cavity 60*a* includes a composite resonator 56*a* which sits atop a pedestal support 58. Similarly, a second composite resonator 56*b* sits atop a pedestal 58 in cavity 60*b*. In real life, all resonators 10 et seq. shown in FIGS. 4–10 sit on pedestals like 58 but are not shown because they are well known in the prior art. Such pedestals, sometimes referred to as "toadstools", typically have a low $\in$ (in range of 2–6) and are made of foam or $B_eO$. Partition, or wall, 62 separates cavity 60*a* from 60*b*. A window 64 is located in wall 62 and includes a tunable iris 66 for selectively coupling energy from composite resonator 56*b* to composite resonator 56*a*. A tunable resonator having an acceptable iris structure is described in U.S. Pat. No. 5,220,300 issued on Jun. 15, 1993 and assigned by Richard V. Snyder to RS Microwave, Inc., Butler, N.J.

Figure 7:
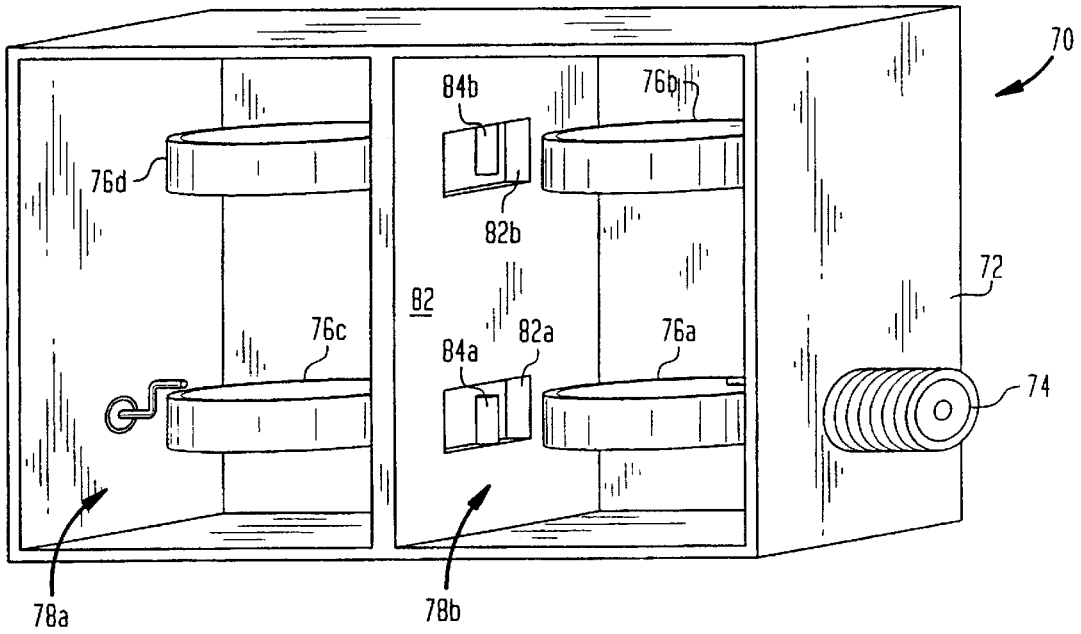
FIGS. 7, 8 and 9 are perspective views of other alternative, hybrid embodiments illustrating cross coupled array filters in which four metal dielectric composite resonators according to the present invention are coupled by various means.

A cross-coupled array filter 70 embodiment is illustrated in FIG. 7. The housing structure 72 includes a standard energy port 74 and defines a pair of interior cavities 78*a* and 78*b*. A first and a second composite resonator 76*a* and 76*b*, respectively, are located within cavity 78*b*. Similarly, a third and fourth composite resonator 76*c* and 76*d* are located within cavity 78*a*. A partition, or wall, 82 separates cavities 78*a* and 78*b*. A pair of windows 82*a* and 82*b* is located in partition 82. Window 82*a* includes a tunable iris 84*a*. Likewise, window 82*b* includes a tunable iris 84*b*. Tunable irises 84*a* and 84*b* can be identical to those described in U.S. Pat. No. 5,220,330. Energy from the first composite resonator 76*a* can be selectively coupled through iris 84*a* to the third composite resonator 76*c*. Likewise, energy from the second composite resonator 76*b* can be coupled through iris 84*b* to the fourth composite resonator 76*d*.

Figure 8:
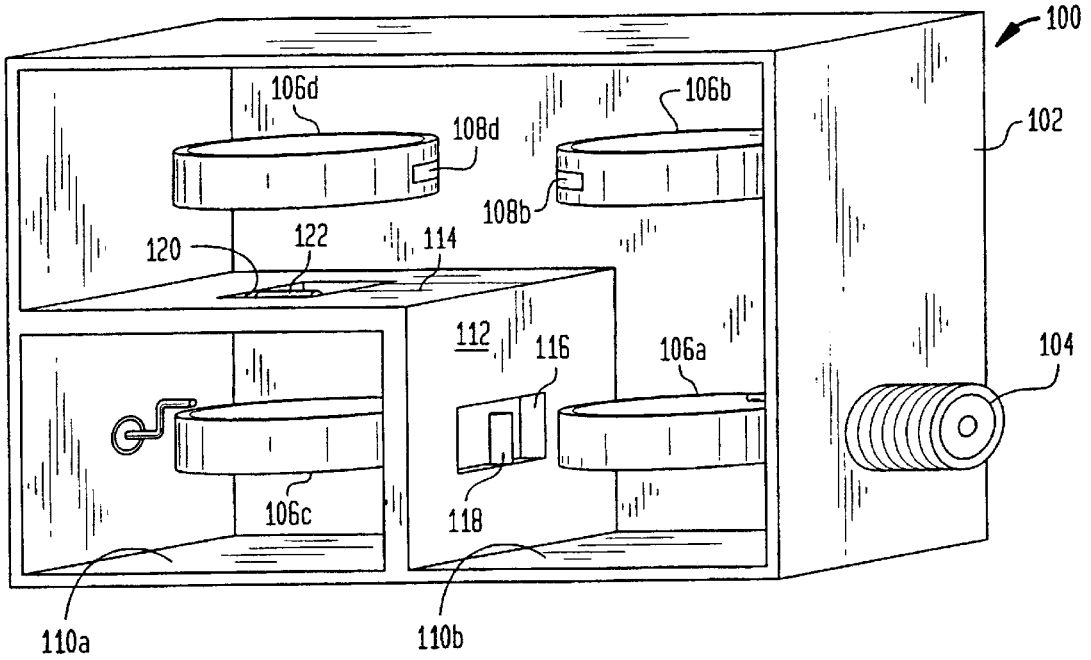

FIG. 8 illustrates another alternative embodiment 100 which is a combination, or hybrid, of the window and iris coupling mechanisms. As illustrated in FIG. 8, the combination embodiment 100 is housed in a structure 102 and includes a standard energy coupling 104. Housing 102 includes interior cavities 110*a* and 110*b*. Cavity 110*b* houses a first, second, and fourth composite resonator 106*a*, 106*b* and 106*d*, respectively. Cavity 110*a* houses third composite resonator 106*c*. The second and fourth resonators 106*b* and 106*d* each include a window 108*b* and 108*d*, respectively, which face each other and which couple energy from the second composite resonator 106*b* to the fourth composite resonator 106*d* in the manner previously described with reference to FIG. 5. The interior cavity 110*a* is defined by right angle panels or partitions 112 and 114, respectively. Panel 112 includes a window 116 and a tunable iris 118, similar to that described in U.S. Pat. No. 5,220,300 for coupling energy from the first composite resonator 106*a* to the third composite resonator 106*c*. Similarly, panel 114 includes a window 120, and a tunable iris 122, for selectively coupling energy from the fourth composite resonator 106*d* to the third composite resonator 106*c*.

Figure 9:
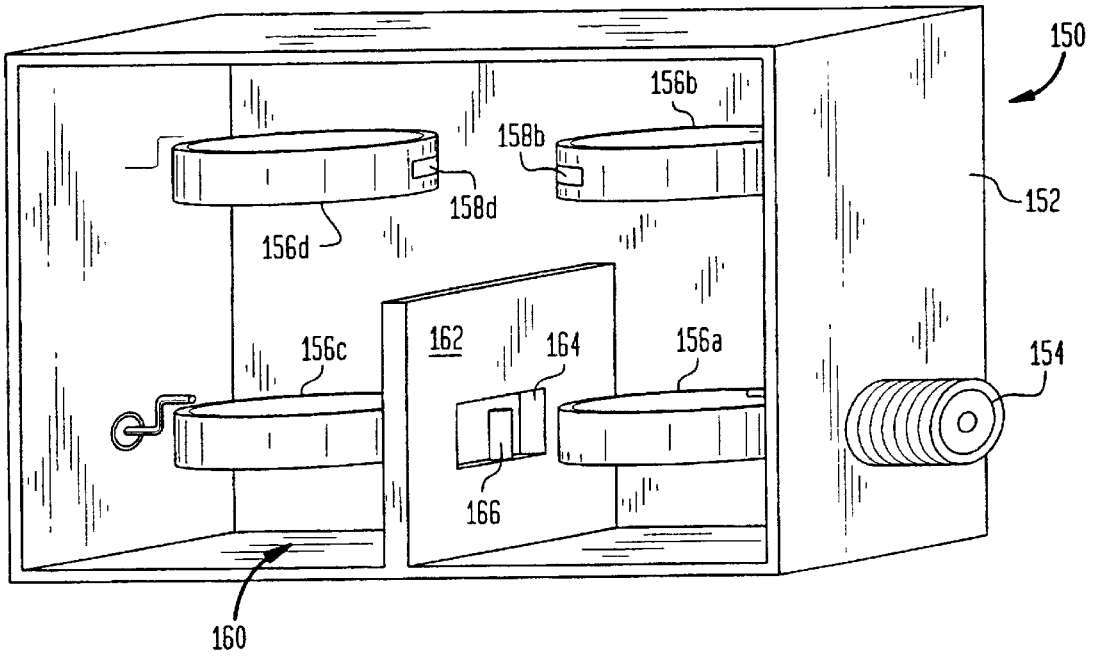

Another combination or hybrid coupling embodiment 150 is illustrated in FIG. 9. The resonators are located within a housing structure 152 which includes the standard energy port 154. Housing 152 defines a single interior cavity 160 which houses a first, second, third and fourth composite resonator 156*a*, 156*b*, 156*c* and 156*d*, respectively. The second and fourth composite resonators 156*b* and 156*d* each include windows, or apertures, 158*b* and 158*d*, respectively, which couple energy from the second composite resonator 156*b* to the fourth composite resonator 156*d*. A partition, or wall, 162 separates the first composite resonator 156*a* from the third composite resonator 156*c*. A window 164 is located in the wall 162 and includes a tunable iris 166, similar to that described in U.S. Pat. No. 5,220,300 for coupling energy from the first composite resonator 156*a* to the third composite resonator 156*c*.

Figure 10:
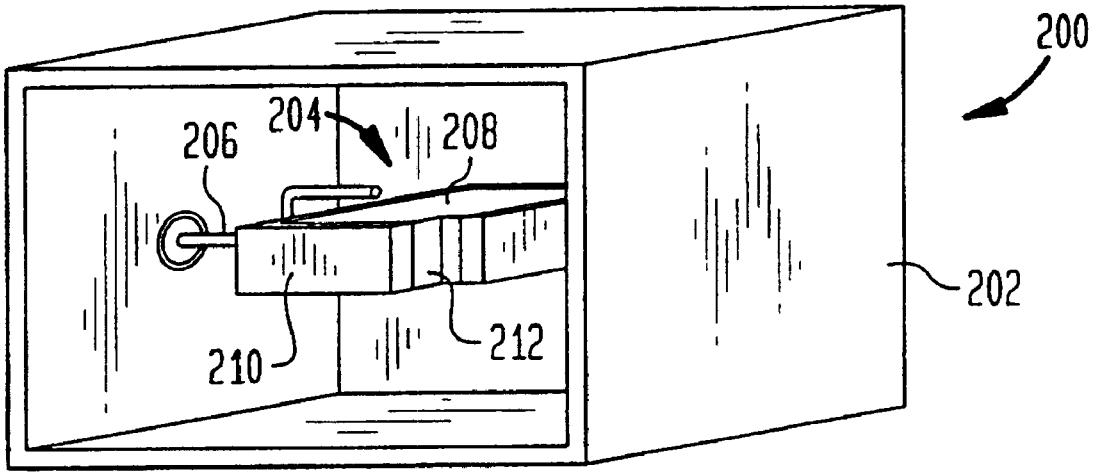
FIG. 10 perspective view of another alternative embodiment illustrating a metal dielectric composite resonator according to the present invention employed in a dual mode filter configure.

FIG. 10 illustrates a single resonator 204, dual mode, configuration 200 that takes advantage of the fact that substantially bound modes become unbound where perturbations are present. The resonator 204 has a distinctly rectangular shape and is located within housing 202. It is feed energy by a conventional probe 206 and includes a rectangular dielectric core 208 partially, but not entirely, surrounded by a metallized peripheral layer 210. A three-dimensional orthogonal notch 212 is taken out of one comer of the composite resonator 204. The notch 212 provides for coupling of dual $TM_{529}$ modes in the resonator 204. A high dielectric constant structure can support more than one bound mode simultaneously, either as degenerate (i.e., field orthogonal, but resonant, at the same frequency) or as separate modes separated in the frequency domain. Consequently, multimode filter configurations are attainable, as depicted in FIG. 10.

As depicted in each of FIGS. 4–10, the structure of the apparatus's enclosure is too small to be resonant at frequencies at or below that of the high dielectric constant structure. Consequently, the enclosure is not a fundamental resonator in itself, but rather is below cutoff (i.e. only propagation of evanescent modes is possible within the enclosure, external to the high dielectric constant structure).

Figure 11A:
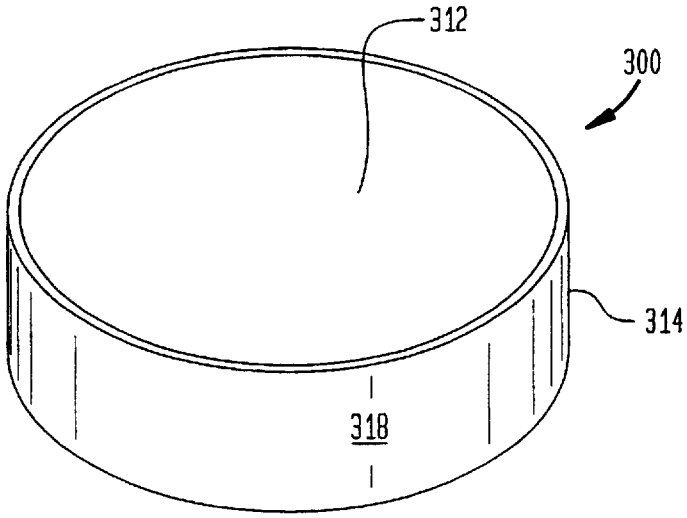
FIG. 11*a* is a perspective view of an alternative embodiment of a resonator with a shape similar to the preferred embodiment shown in FIGS. 3*a*–3*c* but having a metallic core and an external layer of dielectric material surrounding most of the surface of the metallic core.
Figure 11B:
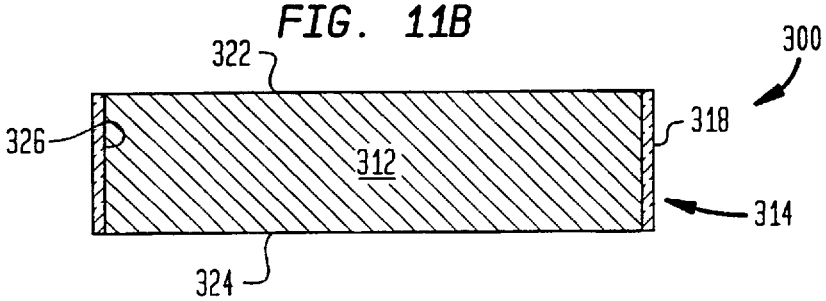
FIG. 11*b* is a vertical cross-sectional view of the alternative embodiment of the resonator shown in FIG. 11*a*.
Figure 11C:
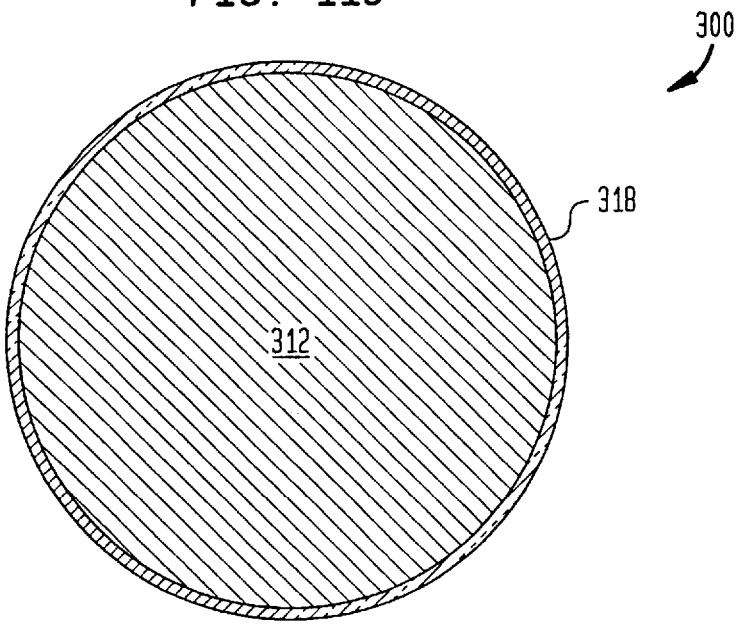
FIG. 11*c* is a top cross-sectional view of the alternative embodiment of the resonator shown in FIGS. 11*a* and 11*b*.
Figure 12:
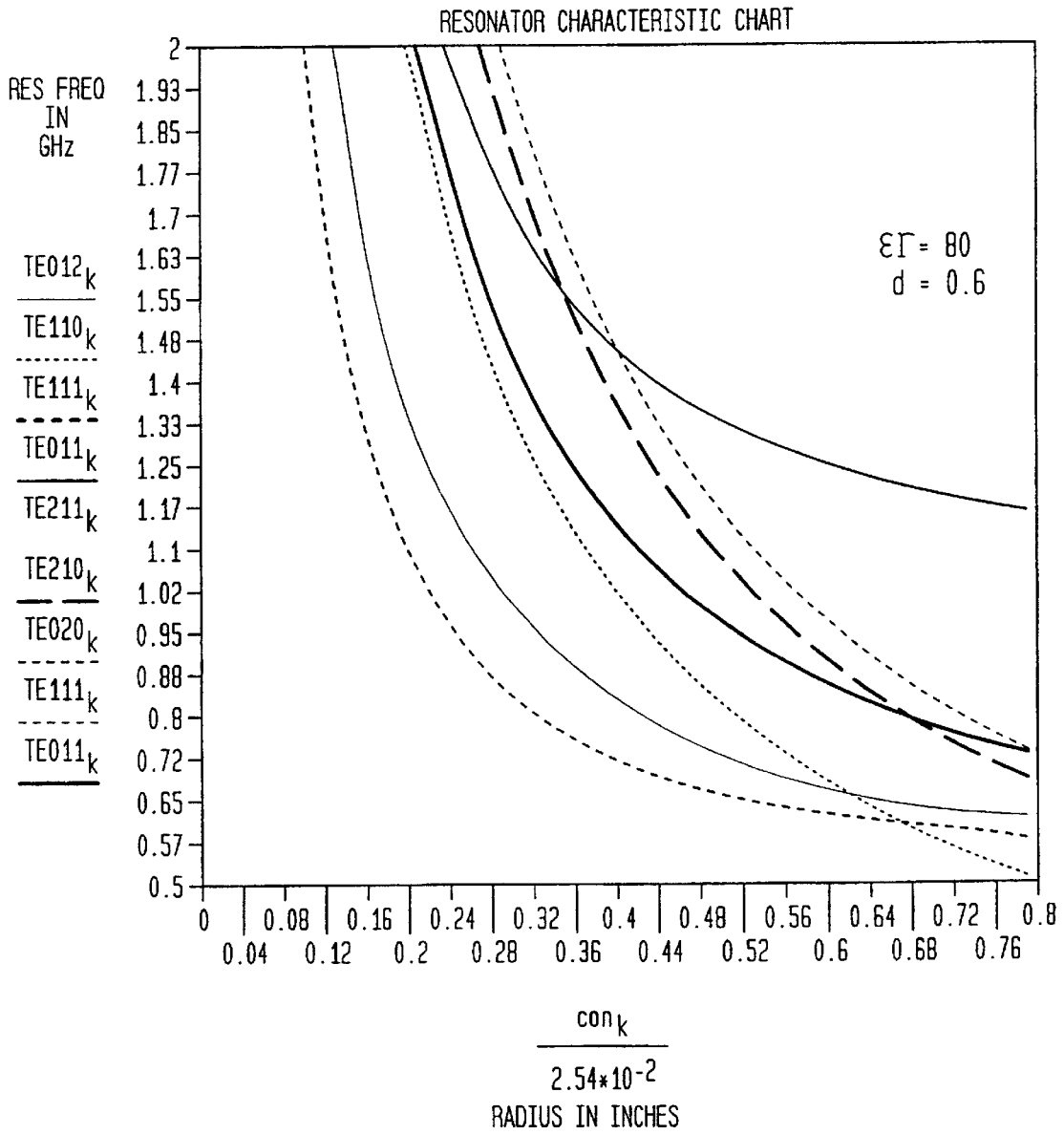
FIG. 12 is a resonator characteristic graph providing an example of how a typical resonator, according to the preferred embodiment of the invention, is structured and designed.

A composite resonator element 300, according to an alternative embodiment of the invention, is illustrated in FIGS. 11*a*–11*c*. The size and shape of resonator 300 is essentially the same as the preferred embodiment 10 shown in FIGS. 3*a*–3*c* except with the metallic and dielectric materials reversing roles and positions. Accordingly, the alternative resonator 300 includes a metallic core 312 surrounded by a dielectric layer 314 to form a "doughnut" or "hockey puck" shape. The metallic core includes a top surface or face 322, a bottom surface or face 324 and an interior sidewall surface or face 326. As best seen in FIG. 11*b*, the circumference 326 of metallic core 312 is surrounded by a sidewall dielectric band or layer 318. The dielectric layer 314 is, therefore, composed of the sidewall band or layer 318.

EXAMPLE 1

For comparison purposes, a calculation was made with the standard Trans-Tech Dielectric Resonator Design package (available from Trans-Tech, 552 Adamstown Road, Adamstown, Md. 21710) for a conventional prior art resonator with an $\in_r$=80 to obtain a desired frequency of 0.733 GHz. The ultimate dielectric required a width of 1.940" by 0.873". The volume then is $\pi r^2 h$=2.58 $in^3$.

In contrast, using commercial available Mathcad™ 7 program distributed by MathSoft, Inc., 101 Main Street, Cambridge, Mass. 02142, the following calculations were obtained:

| | | | |
|---|---|---|---|
| Structure Inputs: | radius in inches | a: = .784 | |
| | height in inches | d: = .63 | |
| | relative permittivity of dielectric | $\epsilon_r$: = 80 | |
| | conductivity of metal | met: = 3 metal | = 1 aluminum .3817 |
| | | | = 2 silver .6173 |
| | | | = 3 copper .58 |
| | relative permittivity of metal | $\mu$met: = .9999736 | |
| | cut plane distance | zd: = 1 d | |
| | (decimal percentage of total height) | | |

Field Plot Inputs:
Choose a value [0, 1] for TE: TE: = 1
TE = 1 for TE calculations
TE = 1 for TM calculations $$\text{check} := \begin{cases} \text{"Enter in a 0 or 1 value only" if TE} > 1 \\ \text{"okay" otherwise} \end{cases}$$

check = "okay"

Choose Mode number
N is the number of circumferential variations in the field N: = 0 M: = 1 L: = 1

-continued

M is the number of radial variations
L is the number of axial variations $$\text{check} := \begin{cases} \text{"Enter in a L >= 1" if } L < 1 \\ \text{"Enter in a M > 1" if } M < 1 \end{cases} \qquad TE_{nml} = root_{NM}$$

$$\begin{cases} \text{"Enter in a M >= 1" if } M < 1 \\ \text{"okay" otherwise} \end{cases} \qquad TE_{nml}\ root_{NM}$$

$$\text{check} = \text{"okay"} \qquad TM_{\phi rz} = root_{NM}$$

Define cutplane for field plots: Option 1 - $\phi$ cut with $\phi = 90°$ option: = 3
Option 2 - $\phi$ cut with $\phi = 0°$
Option 3 - Z cut with $0 < z < d$ Constants: $\epsilon 0 := 8.854187817 \cdot 10^{-12}$ $\mu 0 := 4 \cdot \pi \cdot 10^{-7}$ $j := \sqrt{-1}$ $$c := \frac{1}{\sqrt{\mu 0 \cdot \varepsilon 0 \cdot \varepsilon r}} \qquad c = 3.352 \cdot 10^7 \qquad \eta := \sqrt{\frac{\mu 0}{\varepsilon 0 \cdot \varepsilon r}}$$

Calculate Bessel function:

$$\text{guess}(n, r) := \pi\left(r + \frac{n}{2} - \frac{1}{4}\right) - \frac{4 \cdot n^2 - 1}{8 \cdot \left[\pi \cdot \left(r + \frac{n}{2} - \frac{1}{4}\right)\right]}$$

$$TOL := 10^{-8}$$

$$jn(n, x) := root(Jn(n, x), x) \begin{bmatrix} P_{01} & P_{02} & P_{03} \\ P_{11} & P_{12} & P_{13} \\ P_{21} & P_{22} & P_{23} \end{bmatrix} = \begin{bmatrix} 2.405 & 5.520 & 8.652 \\ 3.832 & 7.016 & 10.176 \\ 5.135 & 8.417 & 11.62 \end{bmatrix}$$

jroot(n,r): = jn(n,guess(n,r))
range variables: n: = 0 . . . 4 m: = 1 . . . 4
$roots_{nm}$: = jroot(n,m) $roots_{NM} = 2.405$ $$roots = \begin{bmatrix} 0 & 2.405 & 5.52 & 8.654 & 11.792 \\ 0 & 3.832 & 7.016 & 10.173 & 13.324 \\ 0 & 5.136 & 8.417 & 11.62 & 14.796 \\ 0 & 6.38 & 9.761 & 13.015 & 16.223 \\ 0 & 7.588 & 11.065 & 14.373 & 17.616 \end{bmatrix}$$

$$\text{guess}(n, m) := \pi \cdot \left(m + \frac{n}{2} - \frac{1}{4}\right) - \frac{4 \cdot n^2 - 1}{8 \cdot \left[\pi \cdot \left(m + \frac{n}{2} - \frac{1}{4}\right)\right]}$$

$$TOL := 10^{-3}$$

$$j'n(x, n) := root\left(\frac{d}{dx} Jn(n, x), x\right) \quad j'0(x) := root(-J1(x), x)$$

j'root(n,m) := if(n = 0,j'0(guess(1,m)),j'n(n,guess(n − 1,m)))
$roots'_{n,m}$: = j'root(n,m)

$$roots' = \begin{pmatrix} 0 & 3.832 & 7.016 & 10.173 & 13.324 \\ 0 & 1.841 & 5.332 & 8.535 & 11.705 \\ 0 & 3.056 & 6.707 & 9.97 & 13.168 \\ 0 & 4.199 & 8.016 & 11.346 & 14.581 \\ 0 & 5.318 & 9.285 & 12.682 & 15.964 \end{pmatrix} \quad roots'_{N,M} = 3.832$$

$$p_{n,m} := \frac{roots_{n,m}}{acm} \qquad p'_{n,m} := \frac{roots'_{n,m}}{acm}$$

-continued

Part 1: Calculate Cutoff Frequency:

$$fcut := \begin{cases} \dfrac{roots'_{N,M}}{2\cdot\pi\cdot acm\sqrt{\mu 0\cdot\varepsilon 0\cdot\varepsilon r}} & \text{if } TE = 1 \\ \dfrac{roots_{N,M}}{2\cdot\pi\cdot\sqrt{\mu 0\cdot\varepsilon 0\cdot\varepsilon r}} & \text{if } TE \neq 1 \end{cases}$$

Part 2: Calculate Resonant Frequency:

$$fres := \begin{cases} \left[\dfrac{c}{4\cdot\pi}\sqrt{\left(\dfrac{roots'_{N,M}}{acm}\right)^2 + \left(\dfrac{L\cdot\pi}{dcm}\right)^2}\right] & \text{if } TE = 1 \\ \left[\dfrac{c}{4\cdot\pi}\sqrt{\left(\dfrac{roots_{N,M}}{acm}\right)^2 + \left(\dfrac{L\cdot\pi}{dcm}\right)^2}\right] & \text{if } TE \neq 1 \end{cases}$$

$$fres = 7.332\cdot 10^8$$

Here the volume is $\pi r^2 h = 1.21\ in^3$. Therefore, the metal ring resonator 10 has 1.21/2.58=47% of the volume of a conventional all dielectric resonator as shown in FIG. 1 with the same $\in r=80$.

While the invention has been described with reference to the preferred embodiment thereof, it will be appreciated by those of ordinary skill in the art that various modifications can be made to the structure and function of the individual parts of the system without departing from the spirit and scope of the invention as a whole.

What is claimed is:

1. A resonator apparatus that resonates in a substantially bound mode for use inside of a structure having at least one cavity, said resonator comprising:

a dielectric core having an exterior surface with at least two faces;

a metallic layer covering substantially all of at least one face;

means for producing a disturbance on one said exterior faces of said dielectric core;

wherein said resonator resonates in a substantially bound mode and wherein said resonator resonates at least two peak frequencies and wherein said resonant frequency is below the normal cutoff resonant frequency of said cavity.

2. A resonator apparatus that resonates in a substantially bound mode for use inside of a structure having at least one cavity, said resonator comprising:

a dielectric core having an exterior surface with at least two faces; and, a metallic layer covering substantially all of at least one face;

wherein said resonator resonates in a substantially bound mode and wherein none of said at least one cavity is a fundamental resonator.

3. A resonator apparatus comprising at least a first resonator that resonates in a substantially bound mode for use inside of a structure having at least one cavity, said first resonator comprising:

a dielectric core having an exterior surface with at least two faces; and, a metallic layer covering substantially all of at least one face;

wherein said first resonator resonates in a substantially bound mode and wherein said dielectric core has a substantially rectangular shape having at least four corners and wherein at least one of said corners includes a notch for coupling dual $TM_{11}$ modes and wherein said resonator resonates in at least two modes.

* * * * *